US011443666B2

(12) United States Patent
Huang

(10) Patent No.: US 11,443,666 B2
(45) Date of Patent: Sep. 13, 2022

(54) DRIVE CIRCUIT FOR ADJUSTING A VOLTAGE REQUIRED FOR AGING DETECTION USING A FEEDBACK CIRCUIT, AND DISPLAY PANEL

(71) Applicant: HKC CORPORATION LIMITED, Guangdong (CN)

(72) Inventor: Xiaoyu Huang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/273,315

(22) PCT Filed: Dec. 7, 2018

(86) PCT No.: PCT/CN2018/119662
§ 371 (c)(1),
(2) Date: Mar. 4, 2021

(87) PCT Pub. No.: WO2020/103205
PCT Pub. Date: May 28, 2020

(65) Prior Publication Data

US 2021/0335169 A1 Oct. 28, 2021

(30) Foreign Application Priority Data

Nov. 21, 2018 (CN) ..... 201811390170.X

(51) Int. Cl.
*G09G 3/00* (2006.01)
*G09G 3/36* (2006.01)

(52) U.S. Cl.
CPC ..... *G09G 3/006* (2013.01); *G09G 3/3696* (2013.01); *G09G 2320/043* (2013.01)

(58) Field of Classification Search
None
See application file for complete search history.

(56) References Cited

U.S. PATENT DOCUMENTS

2014/0203791 A1 7/2014 Lee et al.
2018/0293946 A1* 10/2018 Li ..... G09G 3/3406
(Continued)

FOREIGN PATENT DOCUMENTS

CN 1566980 A * 1/2005
CN 1566980 A 1/2005
(Continued)

OTHER PUBLICATIONS

First Office Action in counterpart Chinese Application No. 201811390170.X, dated Feb. 6, 2020.
(Continued)

*Primary Examiner* — Kirk W Hermann

(57) ABSTRACT

A drive circuit for adjusting a voltage required for aging detection using a feedback circuit comprises a drive chip (100), a detection signal generation circuit (200), and a feedback circuit (300). The drive chip (100) is configured to output a working voltage. The detection signal generation circuit (200) is configured to generate a detection control signal for aging detection according to a received trigger signal. The feedback circuit (300) is configured to receive the detection control signal output by the detection signal generation circuit (200) and the working voltage provided by the drive chip (100) and to generate a feedback voltage according to the detection control signal and the working voltage and output the feedback voltage to the drive chip (100), such that the drive chip (100) adjusts, according to the feedback voltage, the working voltage to a voltage required for aging detection. A display panel is also provided.

18 Claims, 3 Drawing Sheets

(56) References Cited

U.S. PATENT DOCUMENTS

| | | | | |
|---|---|---|---|---|
| 2018/0314119 | A1* | 11/2018 | Zuo | G09G 3/006 |
| 2018/0322829 | A1* | 11/2018 | Xie | G09G 3/3233 |
| 2018/0373094 | A1* | 12/2018 | Ryoo | H05B 45/46 |

FOREIGN PATENT DOCUMENTS

| | | | | |
|---|---|---|---|---|
| CN | 1629928 | A | | 6/2005 |
| CN | 1702729 | A | | 11/2005 |
| CN | 101183831 | A | | 5/2008 |
| CN | 201503686 | U | | 6/2010 |
| CN | 102478611 | A | | 5/2012 |
| CN | 202421370 | U | | 9/2012 |
| CN | 103137051 | A | | 6/2013 |
| CN | 103280847 | A | | 9/2013 |
| CN | 103677053 | A | | 3/2014 |
| CN | 104575382 | A | | 4/2015 |
| CN | 104835435 | A | | 8/2015 |
| CN | 106710531 | A | | 5/2017 |
| CN | 206433225 | U | * | 8/2017 |
| CN | 207909491 | U | | 9/2018 |
| CN | 108615491 | A | | 10/2018 |
| CN | 209593813 | U | * | 11/2019 |
| WO | 2018051943 | A1 | | 3/2018 |

OTHER PUBLICATIONS

International Search Report in corresponding PCT Application No. PCT/CN2018/119662, dated Aug. 29, 2019 and Written Opinion of the International Searching Authority in corresponding PCT Application No. PCT/CN2018/119662, dated Aug. 29, 2019.

* cited by examiner

DRIVE CIRCUIT FOR ADJUSTING A VOLTAGE REQUIRED FOR AGING DETECTION USING A FEEDBACK CIRCUIT, AND DISPLAY PANEL

CROSS-REFERENCE TO RELATED APPLICATIONS

This application is the national stage of International Application No. PCT/CN2018/119662, filed on Dec. 7, 2018, which claims priority to Chinese Patent Application No. 201811390170.X, filed on Nov. 21, 2018, and entitled "Drive Circuit and Display Panel", the entire content of which is hereby incorporated by reference.

TECHNICAL FIELD

The present disclosure relates to the technical field of display, in particular to a drive circuit and a display panel.

BACKGROUND

The statements herein only provide background information related to this application and does not necessarily constitute prior art.

The statement herein only provides background information related to this application and does not necessarily constitute prior art. Thin Film Transistor Liquid Crystal Display (TFT-LCD) panel is one of the main flat panel display products, and has become an important display platform in modern information technology industry and video products. During the working process of the TFT-LCD display panel, power supply and signals are provided to the display area mainly through the drive chip on the printed circuit board, thus to realize image display.

In the production process, an aging detection is usually carried out after the display panel is manufactured. The aging detection is mainly used for detecting whether there are problems such as liquid crystal cell line defects, slight damages to electronic components and the like. When users using the display panel, those problems easily lead to defects of the display panel, such as wire breakage, corrosion and the like, and seriously affect the quality of the product. However, the conventional aging detection design cannot meet the customers' demand for the diversity of voltages used in the aging detection process.

SUMMARY

Based on the above, the present application provides a drive circuit and a display panel to solve the situation that the diversity requirements of customers for voltages required for aging detections cannot be met.

An embodiment of that present application provides a drive circuit including:

a drive chip for outputting a working voltage;

a detection signal generation circuit for receiving a trigger signal and generating a detection control signal for an aging detection according to the trigger signal; and a feedback circuit, a first input terminal of the feedback circuit being electrically connected with a voltage output terminal of the drive chip, a second input terminal of the feedback circuit being electrically connected with an output terminal of the detection signal generation circuit, an output terminal of the feedback circuit being electrically connected with a feedback voltage input terminal of the drive chip, the feedback circuit being configured for receiving the detection control signal output by the detection signal generation circuit and the working voltage provided by the drive chip, generating a feedback voltage according to the detection control signal and the working voltage and output the feedback voltage to the drive chip, thereby the drive chip adjusting the working voltage to a voltage required for the aging detection according to the feedback voltage.

In one embodiment, the feedback circuit includes:

an adjustment branch electrically connected with the voltage output terminal of the drive chip through the first input terminal of the feedback circuit, and electrically connected with the feedback voltage input terminal of the drive chip through the output terminal of the feedback circuit, the adjustment branch being configured for generating the feedback voltage according to the detection control signal and the working voltage and outputting the feedback voltage to the drive chip, thereby the drive chip adjusting the working voltage to the voltage required for the aging detection according to the feedback voltage; and a switch branch, a first input terminal of the switch branch being electrically connected with the output terminal of the detection signal generation circuit, a second input terminal of the switch branch being electrically connected with the adjustment branch through the second output terminal of the adjustment branch, and an output terminal of the switch branch being electrically connected with the feedback voltage input terminal of the drive chip and the output terminal of the feedback circuit, and the switch branch being configured for receiving the detection control signal and controlling the feedback voltage output by the adjustment branch according to the detection control signal.

In one embodiment, the switch branch includes a switch tube, a gate of the switch tube being electrically connected to the output terminal of the detection signal generation circuit, a drain of the switch tube being electrically connected to the feedback voltage input terminal of the drive chip and the output terminal of the feedback circuit, and a source of the switch tube being electrically connected to the second output terminal of the adjustment branch.

In one embodiment, the adjustment branch includes:

a first resistor, one terminal of the first resistor being electrically connected with the feedback voltage input terminal of the drive chip, and another terminal of the first resistor being grounded;

a second resistor, one terminal of the second resistor being electrically connected with the voltage output terminal of the drive chip, and another terminal of the second resistor being electrically connected with the first resistor, a feedback voltage input terminal of the drive chip and the drain of the switch tube; and a third resistor, one terminal of the third resistor being electrically connected with the source of the switch tube, and another terminal of the third resistor being electrically connected with the voltage output terminal of the drive chip and the second resistor.

In one embodiment, the detection signal generation circuit includes:

a voltage input branch for receiving a trigger signal; and a trigger branch electrically connected with the voltage input branch and the feedback circuit, wherein the trigger signal is input to the trigger branch through the voltage input branch, and the trigger branch is configured for generating the detection control signal according to the trigger signal and supplying the detection control signal to the feedback circuit.

In one embodiment, the voltage input branch includes a trigger signal input terminal electrically connected to a second input terminal of the trigger branch.

In one embodiment, the trigger branch includes:

a flip-flop, a first input terminal of the flip-flop being electrically connected with a forward output terminal of the flip-flop and the gate of the switch tube, and a second input terminal of the flip-flop being electrically connected with the trigger signal input terminal;

an inverter, an input terminal of the inverter being electrically connected with the forward output terminal of the flip-flop, and an output terminal of the inverter being electrically connected with the first input terminal of the flip-flop and the gate of the switch tube; and a fourth resistor, one terminal of the fourth resistor being electrically connected with the first input terminal of the flip-flop, the output terminal of the inverter and the gate of the switch tube, and another terminal of the fourth resistor being grounded.

In one embodiment, the flip-flop is a D flip-flop.

In one embodiment, the trigger branch includes:

a flip-flop, wherein a first input terminal of the flip-flop being electrically connected with a reverse output terminal of the flip-flop and the gate of the switch tube, and a second input terminal of the flip-flop being electrically connected with the trigger signal input terminal; and a fourth resistor, one terminal of the fourth resistor being electrically connected with the first input terminal of the flip-flop, the reverse output terminal of the flip-flop and the gate of the switch tube, and another terminal of the fourth resistor being grounded.

In one embodiment, the switch tube is a triode or a field effect transistor.

In one embodiment, the switch tube is a P-type switch tube.

Based on a same inventive concept, an embodiment of the present application provides a display panel including:

a display area for displaying according to a drive signal, and a peripheral circuit area electrically connected with the display area for supplying power to the display area and providing the drive signal;

where the peripheral circuit area includes a drive circuit, and the drive circuit includes:

a drive chip for outputting a working voltage;

a detection signal generation circuit for receiving a trigger signal and generating a detection control signal for an aging detection according to the trigger signal; and a feedback circuit, a first input terminal of the feedback circuit being electrically connected with a voltage output terminal of the drive chip, a second input terminal of the feedback circuit being electrically connected with an output terminal of the detection signal generation circuit, an output terminal of the feedback circuit being electrically connected with a feedback voltage input terminal of the drive chip, the feedback circuit being configured for receiving the detection control signal output by the detection signal generation circuit and the working voltage provided by the drive chip, generating a feedback voltage according to the detection control signal and the working voltage and output the feedback voltage to the drive chip, thereby the drive chip adjusting the working voltage to a voltage required for the aging detection according to the feedback voltage.

In one embodiment, the feedback circuit includes:

an adjustment branch electrically connected with the voltage output terminal of the drive chip through the first input terminal of the feedback circuit, and electrically connected with the feedback voltage input terminal of the drive chip through the output terminal of the feedback circuit, the adjustment branch being configured for generating the feedback voltage according to the detection control signal and the working voltage and outputting the feedback voltage to the drive chip, thereby the drive chip adjusting the working voltage to the voltage required for the aging detection according to the feedback voltage; and a switch branch, a first input terminal of the switch branch being electrically connected with the output terminal of the detection signal generation circuit, a second input terminal of the switch branch being electrically connected with the adjustment branch through the second output terminal of the adjustment branch, and an output terminal of the switch branch being electrically connected with the feedback voltage input terminal of the drive chip and the output terminal of the feedback circuit, and the switch branch being configured for receiving the detection control signal and controlling the feedback voltage output by the adjustment branch according to the detection control signal.

In one embodiment, the switch branch includes:

a switch tube, a gate of switch tube being electrically connected to the output terminal of the detection signal generation circuit, a drain of the switch tube being electrically connected to the feedback voltage input terminal of the drive chip and the output terminal of the feedback circuit, and a source of the switch tube being electrically connected to the second output terminal of the adjustment branch.

In one embodiment, the adjustment branch includes:

a first resistor, one terminal of the first resistor being electrically connected with the feedback voltage input terminal of the drive chip, and another terminal of the first resistor being grounded;

a second resistor, one terminal of the second resistor being electrically connected with the voltage output terminal of the drive chip, and another terminal of the second resistor being electrically connected with the first resistor, a feedback voltage input terminal of the drive chip and the drain of the switch tube; and a third resistor, one terminal of the third resistor being electrically connected with the source of the switch tube, and another terminal of the third resistor being electrically connected with the voltage output terminal of the drive chip and the second resistor.

In one embodiment, the detection signal generation circuit includes:

a voltage input branch for receiving a trigger signal; and a trigger branch electrically connected with the voltage input branch and the feedback circuit, wherein the trigger signal is input to the trigger branch through the voltage input branch, and the trigger branch is configured for generating the detection control signal according to the trigger signal and supplying the detection control signal to the feedback circuit.

In one embodiment, the voltage input branch includes a trigger signal input terminal electrically connected to a second input terminal of the trigger branch.

In one embodiment, the trigger branch includes:

a flip-flop, a first input terminal of the flip-flop being electrically connected with a forward output terminal of the flip-flop and the gate of the switch tube, and a second input terminal of the flip-flop being electrically connected with the trigger signal input terminal;

an inverter, an input terminal of the inverter being electrically connected with the forward output terminal of the flip-flop, and an output terminal of the inverter being electrically connected with the first input terminal of the flip-flop and the gate of the switch tube; and a fourth resistor, one terminal of the fourth resistor being electrically connected with the first input terminal of the flip-flop, the output terminal of the inverter and the gate of the switch tube, and another terminal of the fourth resistor being grounded.

In one embodiment, the flip-flop is a D flip-flop.

In one embodiment, the trigger branch includes:

a flip-flop, wherein a first input terminal of the flip-flop being electrically connected with a reverse output terminal of the flip-flop and the gate of the switch tube, and a second input terminal of the flip-flop being electrically connected with the trigger signal input terminal; and a fourth resistor, one terminal of the fourth resistor being electrically connected with the first input terminal of the flip-flop, the reverse output terminal of the flip-flop and the gate of the switch tube, and another terminal of the fourth resistor being grounded As such, embodiments of that present application provide a drive circuit and a display panel. The drive circuit includes a drive chip, a detection signal generation circuit and a feedback circuit. The drive chip is configured for outputting a working voltage. The detection signal generation circuit is configured for receiving a trigger signal and generating a detection control signal for performing an aging detection according to the trigger signal. A first input terminal of the feedback circuit is electrically connected with a voltage output terminal of the drive chip, a second input terminal of the feedback circuit is electrically connected with an output terminal of the detection signal generation circuit, and an output terminal of the feedback circuit is electrically connected with the feedback voltage input terminal of the drive chip. The feedback circuit is configured for receiving the detection control signal output by the detection signal generation circuit and the working voltage provided by the drive chip, generating a feedback voltage according to the detection control signal and the working voltage, and outputting the feedback voltage to the drive chip, so that the drive chip adjusts the working voltage to a voltage required for the aging detection according to the feedback voltage. In the drive circuit capable of performing the aging detection provided in the present application, a detection control signal for performing the aging detection can be generated by the detection signal generation circuit, so that the feedback circuit adjusts the voltage output by the drive chip to a voltage required for the aging detection according to the detection control signal. It is convenient to raise the voltage according to actual needs in the aging detection to meet needs of the aging detection and to meet the diversity requirements of voltage required for the aging detection voltage in the aging detection process.

DETAILED DESCRIPTION OF THE EMBODIMENTS

In order to make the above purposes, features and advantages of the present application more apparent and understandable, a detailed description of specific embodiments of the present application are given below in conjunction with the drawings. Many specific details are set forth in the following description to facilitate a full understanding of the present application. However, this application can be implemented in many other ways different from those described herein. Those skilled in the art can make similar modifications without departing from the connotation of this application, and this application is not limited by the specific implementation disclosed below.

Figure 1:
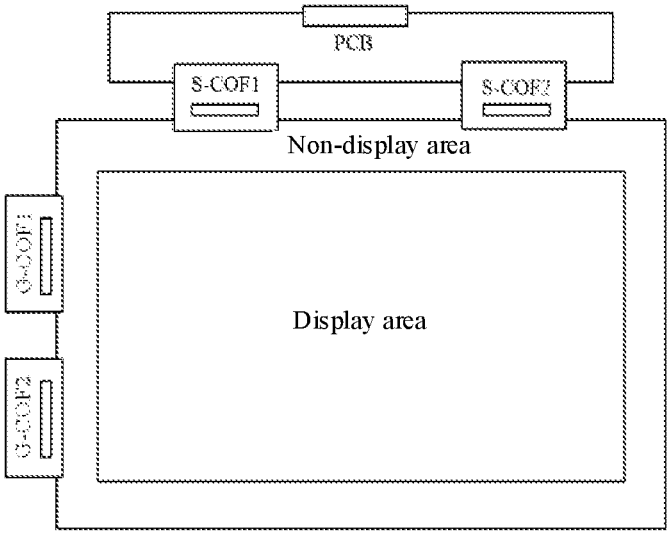
FIG. 1 is a schematic diagram of an electrical structure of an exemplary display panel.

TFT-LCD display panel is one of the main products of flat panel display at present, and has become an important display platform in modern information technology industry and video products. Referring to FIG. 1, a main drive principle of a TFT-LCD display panel includes: a main board of the system connects data such as pixel signals, control signals and power sources with connectors on the printed circuit board (PCB) through wires, the data are processed by a Timing Controller (TCON) integrated circuit on the PCB board, and then connected to a display area through a source-chip on film (S-COF) and a gate-chip on film (G-COF), so that the display area can obtain the required power supply and data to realize image display.

However in a process of production, the display panel is prone to liquid crystal cell line defects, slight damages to electronic components and other problems. Those problems easily lead to defects of the display panel, such as wire breakage, corrosion and the like, which seriously affect the quality of the product. Therefore, an aging detection is required to test whether those problems exist after the manufacturing process of the display panel is completed. However, the conventional aging detection design can no longer meet customers' demand for the diversity of voltages used in the aging detection process.

Figure 2:
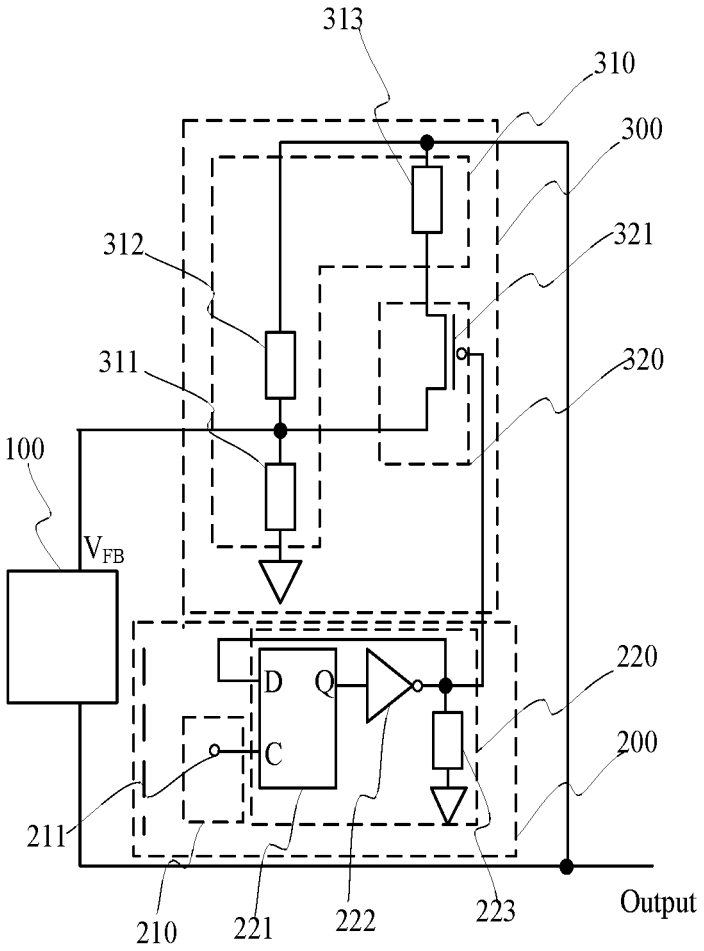
FIG. 2 is a schematic diagram of a circuit structure of a drive circuit provided in an embodiment of the present application.

In view of the above problems, embodiments of the present application provide a drive circuit. Referring to FIG. 2, the drive circuit includes a drive chip 100, a detection signal generation circuit 200, and a feedback circuit 300.

It should be understood that, the drive chip 100 is configured to output a working voltage. The detection signal generation circuit 200 is configured to receive a trigger signal and generate a detection control signal for performing an aging detection according to the trigger signal. A first input terminal of the feedback circuit 300 is electrically connected to a voltage output terminal of the drive chip 100, a second input terminal of the feedback circuit 300 is electrically connected to an output terminal of the detection signal generation circuit 200, and an output terminal of the feedback circuit 300 is electrically connected to a feedback voltage input terminal of the drive chip 100. The feedback circuit 300 is configured for receiving the detection control signal output by the detection signal generation circuit 200 and the working voltage supplied by the drive chip 100, generating a feedback voltage according to the detection control signal and the working voltage and output the feedback voltage to the drive chip 100, so that the drive chip 100 adjusts the working voltage to a voltage required for the aging detection according to the feedback voltage.

It should be understood that, in the drive circuit provided in the present embodiment, a detection control signal for performing the aging detection can be generated by the detection signal generation circuit 200, so that the feedback circuit 300 adjusts a voltage output by the drive chip 100 to that required for the aging detection according to the detection control signal, so that the voltage can be increased according to actual requirements in the aging detection to meet the needs of the aging detection.

In one embodiment, the feedback circuit 300 includes an adjustment branch 310 and a switch branch 320. The adjustment branch 310 is electrically connected to the voltage output terminal of the drive chip 100 through the first input terminal of the feedback circuit 300, the adjustment branch 310 is electrically connected to the feedback voltage input terminal of the drive chip 100 through the output terminal of the feedback circuit 300. The adjustment branch is configured for generating the feedback voltage according to the detection control signal and the working voltage and outputting the feedback voltage to the drive chip 100, so that the drive chip 100 adjusts the working voltage to a voltage required for performing the aging detection according to the feedback voltage. A first input terminal of the switch branch 320 is electrically connected to the output terminal of the detection signal generation circuit 200, a second input terminal of the switch branch 320 is electrically connected to the adjustment branch 310 through a second output terminal of the adjustment branch 310, and an output terminal of the switch branch 320 is electrically connected to the feedback voltage input terminal of the drive chip 100 and the output terminal of the feedback circuit 300, the switch branch is configured for receiving the detection control signal and controlling the feedback voltage output by the adjustment branch 310 according to the detection control signal.

It should be understood that in this embodiment, the feedback voltage generated by the adjustment branch 310 is changed by controlling the turning on and turning off of the switch branch 320, so that the drive chip 100 adjusts an output voltage to a voltage required for the aging detection according to the feedback voltage received during the aging detection.

In one embodiment, the switch branch 320 includes a switch tube 321. A gate of the switch tube 321 is electrically connected to the output terminal of the detection signal generation circuit 200, a drain of the switch tube 321 is electrically connected to the feedback voltage input terminal of the drive chip 100 and the output terminal of the feedback circuit 300, and a source of the switch tube 321 is electrically connected to the second output terminal of the adjustment branch 310. It should be noted that in this embodiment, the first output terminal of the adjustment branch 310 is also the output terminal of the feedback circuit 300.

In one embodiment, the adjustment branch 310 includes a first resistor 311, a second resistor 312, and a third resistor 313. One terminal of the first resistor 311 is electrically connected to the feedback voltage input terminal of the drive chip 100, and the other terminal of the first resistor 311 is grounded. One terminal of the second resistor 312 is electrically connected to the voltage output terminal of the drive chip 100, and the other terminal of the second resistor 312 is electrically connected to the first resistor 311, a feedback voltage input terminal of the drive chip 100, and the drain of the switch tube 321. One terminal of the third resistor 313 is electrically connected to the source of the switch tube 321, and the other terminal of the third resistor 313 is connected to the voltage output terminal of the drive chip 100 and the second resistor 312.

In one embodiment, the detection signal generation circuit 200 includes a voltage input branch 210 and a trigger branch 220. The voltage input branch 210 is configured for receiving a trigger signal. The trigger branch 220 is electrically connected with the voltage input branch 210 and the feedback circuit 300. The trigger signal is input to the trigger branch 220 through the voltage input branch 210. The trigger branch 220 generates the detection control signal according to the trigger signal and supplies the detection control signal to the feedback circuit 300.

In one embodiment, the switch tube 321 is a triode or a FET. In addition, the switch tube 321 can also be replaced by a component with switching characteristics, such as a relay.

In one embodiment, the voltage input branch 210 includes a trigger signal input terminal 211 electrically connected to a second input of the trigger branch 220. It should be understood that, the trigger signal is input through the trigger signal input terminal 211, and provided to the trigger branch 220, so that the trigger branch 220 generates the detection control signal according to the trigger signal. Furthermore, the feedback circuit 300 generates the feedback voltage according to the detection control signal and feeds the detection control signal back to the drive chip 100. The drive chip 100 can adjust the working voltage to a voltage required for performing the aging detection process according to the feedback voltage and output the voltage to the display area of the display panel.

In one embodiment, the trigger branch 220 includes a flip-flop 221, an inverter 222, and a fourth resistor 223. A first input terminal of the flip-flop 221 is electrically connected to a forward output terminal of the flip-flop 221 and the gate of the switch tube 321, and a second input terminal of the flip-flop 221 is electrically connected to the trigger signal input terminal 211. An input terminal of the inverter 222 is electrically connected to the forward output terminal of the flip-flop 221, and an output terminal of the inverter 222 is electrically connected to the first input terminal of the flip-flop 221 and the gate of the switch tube 321. One terminal of the fourth resistor 223 is electrically connected to the first input terminal of the flip-flop 221, the output terminal of the inverter 222 and the gate of the switch tube 321, and the other terminal of the fourth resistor 223 is grounded.

In this embodiment, the switch tube 321 is a P-type FET. When a gate voltage of the switch tube 321 is low, the switch tube 321 is turned on, and when the gate voltage is high, the switch tube 321 is turned off. The flip-flop 221 is a rising edge D flip-flop 221. The first input terminal of the flip-flop 221 is a set terminal, and the second input terminal of the flip-flop 221 is a control terminal of the D flip-flop 221. When the second input terminal of the D flip-flop 221 receives a rising edge of a trigger signal, a logic level of the first input terminal is assigned to the forward output terminal of the D flip-flop 221. When the second input terminal is suspended, that is there is no trigger signal input, a trigger state of the flip-flop 221 is locked and the trigger state remains unchanged. The voltage output from the output terminal of the drive chip 100 is the working voltage actually supplied to the display area. A threshold value of the feedback voltage V FB of the drive chip 100 is 1.25 V. When the feedback voltage received by the drive chip 100 is lower than 1.25 V, the drive chip 100 automatically increases the output voltage according to the feedback voltage.

It should be understood that, when the drive circuit is operating normally, the control terminal of the flip-flop 221 has no signal input and the second input terminal of the flip-flop 221 has no signal input. The flip-flop 221 assigns a value of 1 of the set terminal to the forward output terminal of the flip-flop 221 and outputs 1 to the inverter 222. The inverter 222 reverses the received high level signal to obtain the detection control signal and output the detection control signal to the switch tube 321. At this time, the detection control signal is a low level signal. The gate of the switch tube 321 is at a low level and the switch tube 321 is turned on, the output voltage V1 of the drive chip 100 is equal to 1.25*(Ra+R1)/R1, where Ra=R2*R3/(R2+R3), R1 is a resistance value of the first resistor 311, R2 is a resistance value of the second resistor 312, R3 is a resistance value of the third resistor 313, and R4 is a resistance value of the fourth resistor 223.

When an aging detection is required, a trigger signal is input through the trigger signal input 211, and supplied to the control terminal of the flip-flop 221 through the trigger signal input terminal 211, At this time, the flip-flop 221 assigns a value of 0 at the set terminal to the forward output terminal of the flip-flop 221, and the forward output terminal outputs a low level signal to the inverter 222. The inverter 222 reverses the low level signal to generate a high level detection control signal, so that the gate of the switch tube 321 is at a high level and the switch tube 321 is turned off. At this time, the output voltage V2 of the drive chip 100 is equal to 1.25*(R2+R3)/R2. Moreover, according to the formula, V2>V 1.

Figure 3:
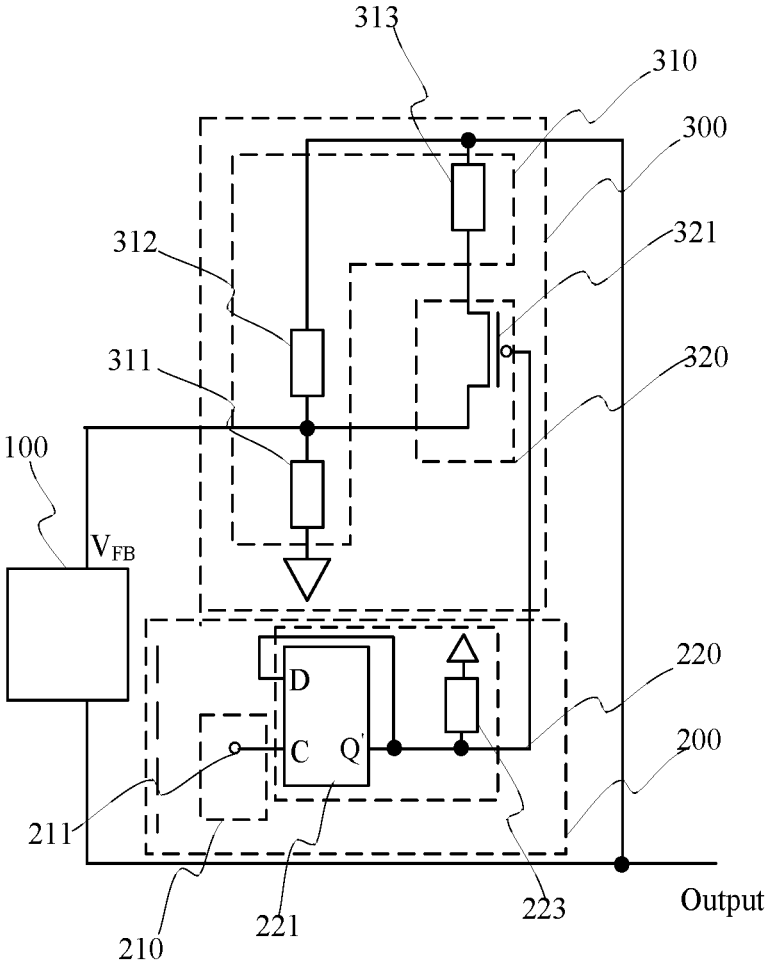
FIG. 3 is a schematic diagram of a circuit structure of another drive circuit provided in an embodiment of the present application.

Referring to FIG. 3, in one embodiment, the trigger branch 220 includes a flip-flop 221 and a fourth resistor 223. A first input terminal of the flip-flop 221 is electrically connected to a reverse output terminal of the flip-flop 221 and the gate of the switch tube 321. A second input terminal of the flip-flop 221 is electrically connected to the trigger signal input terminal 211. One terminal of the fourth resistor 223 is electrically connected to the first input terminal of the flip-flop 221, the reverse output terminal of the flip-flop 221 and the gate of the switch tube 321, and the other terminal of the fourth resistor 223 is grounded.

It should be understood that when the drive circuit is operating normally, the control terminal of the flip-flop 221 has no signal input and the second input terminal of the flip-flop 221 has no signal input. The flip-flop 221 assigns a value of 1 of the set terminal to the reverse output terminal of the flip-flop 221 and the reverse output terminal outputs a low level detection control signal. The gate of the switch tube 321 is at a low level and the switch tube 321 is turned on, the output voltage V1 of the drive chip 100 is equal to 1.25*(Ra+R1)/R1, where Ra=R2*R3/(R2+R3), R1 is the resistance value of the first resistor 311, R2 is the resistance value of the second resistor 312, R3 is the resistance value of the third resistor 313, and R4 is the resistance value of the fourth resistor 223.

When an aging detection is required, a trigger signal is input through the trigger signal input 211, and provided to the control terminal of the flip-flop 221 through the trigger signal input terminal 211. At this time, the flip-flop 221 assigns a value of 0 of the set terminal to the reverse output terminal of the flip-flop 221, and the reverse output terminal outputs a high level signal to the switch tube 321, so that the gate of the switch tube 321 is at a high level and the switch tube 321 is turned off. At this time, the output voltage V2 of the drive chip 100 is equal to 1.25*(R1+R2)/R1. Moreover, according to the formula, V2>V1.

It should be understood that in present embodiment, the feedback voltage of the feedback circuit 300 is changed by changing a resistance value of the feedback circuit 300, thereby changing the actual output voltage of the drive chip 100. Therefore, by adjusting the resistance value of the feedback circuit 300, different voltages required for the aging detection can be obtained to meet the diversity requirements of customers.

Based on a same inventive concept, the present application also provides a display panel including a display area and a peripheral circuit area. The display area is configured for displaying according to the drive signal. The peripheral circuit area is electrically connected with the display area for supplying power to the display area and providing the drive signal.

The drive circuit includes a drive chip 100, a detection signal generation circuit 200, and a feedback circuit 300.

It should be understood that, the drive chip 100 is configured to output a working voltage. The detection signal generation circuit 200 is configured to receive a trigger signal and generate a detection control signal for performing an aging detection according to the trigger signal. A first input terminal of the feedback circuit 300 is electrically connected to a voltage output terminal of the drive chip 100, a second input terminal of the feedback circuit 300 is electrically connected to an output terminal of the detection signal generation circuit 200, and an output terminal of the feedback circuit 300 is electrically connected to a feedback voltage input terminal of the drive chip 100. The feedback circuit 300 is configured for receiving the detection control signal output by the detection signal generation circuit 200 and the working voltage supplied by the drive chip 100, generating a feedback voltage according to the detection control signal and the working voltage and output the feedback voltage to the drive chip 100, so that the drive chip 100 adjusts the working voltage to a voltage required for the aging detection according to the feedback voltage.

In one embodiment, the feedback circuit 300 includes an adjustment branch 310 and a switch branch 320. The adjustment branch 310 is electrically connected to the voltage output terminal of the drive chip 100 through the first input terminal of the feedback circuit 300, the adjustment branch 310 is electrically connected to the feedback voltage input terminal of the drive chip 100 through the output terminal of the feedback circuit 300. The adjustment branch is configured for generating the feedback voltage according to the detection control signal and the working voltage and outputting the feedback voltage to the drive chip 100, so that the drive chip 100 adjusts the working voltage to a voltage required for performing the aging detection according to the feedback voltage. A first input terminal of the switch branch 320 is electrically connected to the output terminal of the detection signal generation circuit 200, a second input terminal of the switch branch 320 is electrically connected to the adjustment branch 310 through a second output terminal of the adjustment branch 310, and an output terminal of the switch branch 320 is electrically connected to the feedback voltage input terminal of the drive chip 100 and the output terminal of the feedback circuit 300. The switch branch is configured for receiving the detection control signal and controlling the feedback voltage output by the adjustment branch 310 according to the detection control signal.

In one embodiment, the switch branch 320 includes a switch tube 321. A gate of the switch tube 321 is electrically connected to the output terminal of the detection signal generation circuit 200, a drain of the switch tube 321 is electrically connected to the feedback voltage input terminal of the drive chip 100 and the output terminal of the feedback circuit 300, and a source of the switch tube 321 is electrically connected to the second output terminal of the adjustment branch 310. It should be noted that in this embodiment, the first output terminal of the adjustment branch 310 is also the output terminal of the feedback circuit 300. The adjustment branch 310 includes a first resistor 311, a second resistor 312, and a third resistor 313. One terminal of the first resistor 311 is electrically connected to the feedback voltage input terminal of the drive chip 100, and the other terminal of the first resistor 311 is grounded. One terminal of the second resistor 312 is electrically connected to the voltage output terminal of the drive chip 100, and the other terminal of the second resistor 312 is electrically connected to the first resistor 311, the feedback voltage input terminal of the drive chip 100, and the drain of the switch tube 321. One terminal of the third resistor 313 is electrically connected to the source of the switch tube 321, and the other terminal of the third resistor 313 is connected to the voltage output terminal of the drive chip 100 and the second resistor 312.

In one embodiment, the detection signal generation circuit 200 includes a voltage input branch 210 and a trigger branch 220. The voltage input branch 210 is configured for receiving a trigger signal. The trigger branch 220 is electrically connected with the voltage input branch 210 and the feedback circuit 300. The trigger signal is input to the trigger branch 220 through the voltage input branch 210. The trigger branch 220 generates the detection control signal according to the trigger signal and supplies the detection control signal to the feedback circuit 300.

In one embodiment, the switch tube 321 is a triode or a FET. In addition, the switch tube 321 can also be replaced by a component with switching characteristics, such as a relay.

In one embodiment, the voltage input branch 210 includes a trigger signal input terminal 211 electrically connected to a second input of the trigger branch 220. It should be understood that, the trigger signal is input through the trigger signal input terminal 211, and provided to the trigger branch 220, so that the trigger branch 220 generates the detection control signal according to the trigger signal. Furthermore, the feedback circuit 300 generates the feedback voltage according to the detection control signal and feeds the detection control signal back to the drive chip 100. The drive chip 100 can adjust the working voltage to a voltage required for performing the aging detection process according to the feedback voltage and output the voltage to the display area of the display panel.

In one embodiment, the trigger branch 220 includes a flip-flop 221, an inverter 222, and a fourth resistor 223. A first input terminal of the flip-flop 221 is electrically connected to a forward output terminal of the flip-flop 221 and the gate of the switch tube 321, and a second input terminal of the flip-flop 221 is electrically connected to the trigger signal input terminal 211. An input terminal of the inverter 222 is electrically connected to the forward output terminal of the flip-flop 221, and an output terminal of the inverter 222 is electrically connected to the first input terminal of the flip-flop 221 and the gate of the switch tube 321. One terminal of the fourth resistor 223 is electrically connected to the first input terminal of the flip-flop 221, the output terminal of the inverter 222 and the gate of the switch tube 321, and the other terminal of the fourth resistor 223 is grounded.

In this embodiment, the switch tube 321 is a P-type FET. When a gate voltage of the switch tube 321 is low, the switch tube 321 is turned on, and when the gate voltage is high, the switch tube 321 is turned off. The flip-flop 221 is a rising edge D flip-flop 221. The first input terminal of the flip-flop 221 is a set terminal, and the second input terminal of the flip-flop 221 is a control terminal of the D flip-flop 221. When the second input terminal of the D flip-flop 221 receives a rising edge of a trigger signal, a logic level of the first input terminal is assigned to the forward output terminal of the D flip-flop 221. When the second input terminal is suspended, that is there is no trigger signal input, a trigger state of the flip-flop 221 is locked and the trigger state remains unchanged. The voltage output from the output terminal of the drive chip 100 is the working voltage actually supplied to the display area. A threshold value of the feedback voltage V FB of the drive chip 100 is 1.25 V. When the feedback voltage received by the drive chip 100 is lower than 1.25 V, the drive chip 100 automatically increases the output voltage according to the feedback voltage.

It should be understood that, when the drive circuit is operating normally, the control terminal of the flip-flop 221 has no signal input and the second input terminal of the flip-flop 221 has no signal input. The flip-flop 221 assigns a value of 1 of the set terminal to the forward output terminal of the flip-flop 221 and outputs 1 to the inverter 222. The inverter 222 reverses the received high level signal to obtain the detection control signal and output the detection control signal to the switch tube 321. At this time, the detection control signal is a low level signal. The gate of the switch tube 321 is at a low level and the switch tube 321 is turned on, the output voltage V1 of the drive chip 100 is equal to 1.25*(Ra+R1)/R1, where Ra=R2*R3/(R2+R3), R1 is a resistance value of the first resistor 311, R2 is a resistance value of the second resistor 312, R3 is a resistance value of the third resistor 313, and R4 is a resistance value of the fourth resistor 223.

When an aging detection is required, a trigger signal is input through the trigger signal input 211, and supplied to the control terminal of the flip-flop 221 through the trigger signal input terminal 211, At this time, the flip-flop 221 assigns a value of 0 at the set terminal to the forward output terminal of the flip-flop 221, and the forward output terminal outputs a low level signal to the inverter 222. The inverter 222 reverses the low level signal to generate a high level detection control signal, so that the gate of the switch tube 321 is at a high level and the switch tube 321 is turned off. At this time, the output voltage V2 of the drive chip 100 is equal to 1.25*(R2+R3)/R2. Moreover, according to the formula, V2>V 1.

In one embodiment, the trigger branch 220 includes a flip-flop 221 and a fourth resistor 223. A first input terminal of the flip-flop 221 is electrically connected to a reverse output terminal of the flip-flop 221 and the gate of the switch tube 321. A second input terminal of the flip-flop 221 is electrically connected to the trigger signal input terminal 211. One terminal of the fourth resistor 223 is electrically connected to the first input terminal of the flip-flop 221, the reverse output terminal of the flip-flop 221 and the gate of the switch tube 321, and the other terminal of the fourth resistor 223 is grounded.

As such, embodiments of that present application provide a drive circuit and a display panel. The drive circuit includes a drive chip 100, a detection signal generation circuit 200, and a feedback circuit 300. The drive chip 100 is configured for outputting a working voltage. The detection signal generation circuit 200 is configured for receiving a trigger signal and generating a detection control signal for performing an aging detection according to the trigger signal. A first input terminal of the feedback circuit 300 is electrically connected to a voltage output terminal of the drive chip 100, a second input terminal of the feedback circuit 300 is electrically connected to an output terminal of the detection signal generation circuit 200, and an output terminal of the feedback circuit 300 is electrically connected to the feedback voltage input terminal of the drive chip 100. The feedback circuit 300 is configured for receiving the detection control signal output by the detection signal generation circuit 200 and the working voltage supplied by the drive chip 100, generating a feedback voltage according to the detection control signal and the working voltage, and outputting the feedback voltage to the drive chip 100, so that the drive chip 100 adjusts the working voltage to a voltage required for an aging detection according to the feedback voltage. In the drive circuit capable of performing an aging detection provided in the present application, a detection control signal for performing the aging detection can be generated by the detection signal generation circuit 200, so that the feedback circuit 300 adjusts the voltage output by the drive chip 100 to a voltage required for the aging detection according to the detection control signal. It is convenient to raise the voltage according to actual needs in the aging detection to meet needs of the aging detection and to meet the diversity requirements of voltage required for the aging detection voltage in the aging detection process.

The technical features of the above-described embodiments can be combined arbitrarily, and not all possible combinations of the technical features of the above-described embodiments have been described for the sake of simplicity of description. However, as long as there is no contradiction between the combinations of these technical features, it should be considered the combinations falls in the scope of this specification.

The above-described embodiments only illustrate several embodiments of the present application, and the description is relatively specific and detailed. However, this cannot be understood as limiting the scope of the application. It should be noted that, for those of ordinary skilled in the art, a number of variations and modifications can be made without departing from the concept of the present application, and all of those variations and modifications fall within the scope of protection of the present application. Therefore, the scope of protection of the application shall be subject to the appended claims.

What is claimed is:

1. A drive circuit comprising:

a drive chip for outputting a working voltage;

a detection signal generation circuit for receiving a trigger signal and generating a detection control signal for an aging detection according to the trigger signal; and a feedback circuit, a first input terminal of the feedback circuit being electrically connected with a voltage output terminal of the drive chip, a second input terminal of the feedback circuit being electrically connected with an output terminal of the detection signal generation circuit, an output terminal of the feedback circuit being electrically connected with a feedback voltage input terminal of the drive chip, the feedback circuit being configured for receiving the detection control signal output by the detection signal generation circuit and the working voltage provided by the drive chip, generating a feedback voltage according to the detection control signal and the working voltage and output the feedback voltage to the drive chip, thereby the drive chip adjusting the working voltage to a voltage required for the aging detection according to the feedback voltage, wherein the feedback circuit comprises:

an adjustment branch electrically connected with the voltage output terminal of the drive chip through the first input terminal of the feedback circuit, and electrically connected with the feedback voltage input terminal of the drive chip through the output terminal of the feedback circuit, the adjustment branch being configured for generating the feedback voltage according to the detection control signal and the working voltage and outputting the feedback voltage to the drive chip, thereby the drive chip adjusting the working voltage to the voltage required for the aging detection according to the feedback voltage; and a switch branch, a first input terminal of the switch branch being electrically connected with the output terminal of the detection signal generation circuit, a second input terminal of the switch branch being electrically connected with the adjustment branch through a second output terminal of the adjustment branch, and an output terminal of the switch branch being electrically connected with the feedback voltage input terminal of the drive chip and the output terminal of the feedback circuit, and the switch branch being configured for receiving the detection control signal and controlling the feedback voltage output by the adjustment branch according to the detection control signal.

2. The drive circuit of claim 1, wherein the switch branch comprises a switch tube, a gate of the switch tube being electrically connected to the output terminal of the detection signal generation circuit, a drain of the switch tube being electrically connected to the feedback voltage input terminal of the drive chip and the output terminal of the feedback circuit, and a source of the switch tube being electrically connected to the second output terminal of the adjustment branch.

3. The drive circuit of claim 2, wherein the adjustment branch comprises:

a first resistor, one terminal of the first resistor being electrically connected with the feedback voltage input terminal of the drive chip, and another terminal of the first resistor being grounded;

a second resistor, one terminal of the second resistor being electrically connected with the voltage output terminal of the drive chip, and another terminal of the second resistor being electrically connected with the first resistor, the feedback voltage input terminal of the drive chip and the drain of the switch tube; and a third resistor, one terminal of the third resistor being electrically connected with the source of the switch tube, and another terminal of the third resistor being electrically connected with the voltage output terminal of the drive chip and the second resistor.

4. The drive circuit of claim 3, wherein the detection signal generation circuit comprises:

a voltage input branch for receiving the trigger signal; and a trigger branch electrically connected with the voltage input branch and the feedback circuit, wherein the trigger signal is input to the trigger branch through the voltage input branch, and the trigger branch is configured for generating the detection control signal according to the trigger signal and supplying the detection control signal to the feedback circuit.

5. The drive circuit of claim 4, wherein the voltage input branch comprises a trigger signal input terminal electrically connected to a second input terminal of the trigger branch.

6. The drive circuit of claim 5, wherein the trigger branch comprises:

a flip-flop, a first input terminal of the flip-flop being electrically connected with a forward output terminal of the flip-flop and the gate of the switch tube, and a second input terminal of the flip-flop being electrically connected with the trigger signal input terminal;

an inverter, an input terminal of the inverter being electrically connected with the forward output terminal of the flip-flop, and an output terminal of the inverter being electrically connected with the first input terminal of the flip-flop and the gate of the switch tube; and a fourth resistor, one terminal of the fourth resistor being electrically connected with the first input terminal of the flip-flop, the output terminal of the inverter and the gate of the switch tube, and another terminal of the fourth resistor being grounded.

7. The drive circuit of claim 6, wherein the flip-flop is a D flip-flop.

8. The drive circuit of claim 5, wherein the trigger branch comprises:

a flip-flop, a first input terminal of the flip-flop being electrically connected with a reverse output terminal of the flip-flop and the gate of the switch tube, and a second input terminal of the flip-flop being electrically connected with the trigger signal input terminal; and a fourth resistor, one terminal of the fourth resistor being electrically connected with the first input terminal of the flip-flop, the reverse output terminal of the flip-flop and the gate of the switch tube, and another terminal of the fourth resistor being grounded.

9. The drive circuit of claim 2, wherein the switch tube is a triode or a field effect transistor.

10. The drive circuit of claim 9, wherein the switch tube is a P-type switch tube.

11. A display panel comprising:

a display area for displaying according to a drive signal, and a peripheral circuit area electrically connected with the display area for supplying power to the display area and providing the drive signal;

wherein the peripheral circuit area comprises a drive circuit, and the drive circuit comprises:

a drive chip for outputting a working voltage;

a detection signal generation circuit for receiving a trigger signal and generating a detection control signal for an aging detection according to the trigger signal; and a feedback circuit, a first input terminal of the feedback circuit being electrically connected with a voltage output terminal of the drive chip, a second input terminal of the feedback circuit being electrically connected with an output terminal of the detection signal generation circuit, an output terminal of the feedback circuit being electrically connected with a feedback voltage input terminal of the drive chip, the feedback circuit being configured for receiving the detection control signal output by the detection signal generation circuit and the working voltage provided by the drive chip, generating a feedback voltage according to the detection control signal and the working voltage and output the feedback voltage to the drive chip, thereby the drive chip adjusting the working voltage to a voltage required for the aging detection according to the feedback voltage, wherein the feedback circuit comprises:

an adjustment branch electrically connected with the voltage output terminal of the drive chip through the first input terminal of the feedback circuit, and electrically connected with the feedback voltage input terminal of the drive chip through the output terminal of the feedback circuit, the adjustment branch being configured for generating the feedback voltage according to the detection control signal and the working voltage and outputting the feedback voltage to the drive chip, thereby the drive chip adjusting the working voltage to the voltage required for the aging detection according to the feedback voltage; and a switch branch, a first input terminal of the switch branch being electrically connected with the output terminal of the detection signal generation circuit, a second input terminal of the switch branch being electrically connected with the adjustment branch through a second output terminal of the adjustment branch, and an output terminal of the switch branch being electrically connected with the feedback voltage input terminal of the drive chip and the output terminal of the feedback circuit, and the switch branch being configured for receiving the detection control signal and controlling the feedback voltage output by the adjustment branch according to the detection control signal.

12. The display panel of claim 11, wherein the switch branch comprises:

a switch tube, a gate of switch tube being electrically connected to the output terminal of the detection signal generation circuit, a drain of the switch tube being electrically connected to the feedback voltage input terminal of the drive chip and the output terminal of the feedback circuit, and a source of the switch tube being electrically connected to the second output terminal of the adjustment branch.

13. The display panel of claim 12, wherein the adjustment branch comprises:

a first resistor, one terminal of the first resistor being electrically connected with the feedback voltage input terminal of the drive chip, and another terminal of the first resistor being grounded;

a second resistor, one terminal of the second resistor being electrically connected with the voltage output terminal of the drive chip, and another terminal of the second resistor being electrically connected with the first resistor, the feedback voltage input terminal of the drive chip and the drain of the switch tube; and a third resistor, one terminal of the third resistor being electrically connected with the source of the switch tube, and another terminal of the third resistor being electrically connected with the voltage output terminal of the drive chip and the second resistor.

14. The display panel of claim 13, wherein the detection signal generation circuit comprises:

a voltage input branch for receiving the trigger signal; and a trigger branch electrically connected with the voltage input branch and the feedback circuit, wherein the trigger signal is input to the trigger branch through the voltage input branch, and the trigger branch is configured for generating the detection control signal according to the trigger signal and supplying the detection control signal to the feedback circuit.

15. The display panel of claim 14, wherein the voltage input branch comprises a trigger signal input terminal electrically connected to a second input terminal of the trigger branch.

16. The display panel of claim 15, wherein the trigger branch comprises:

a flip-flop, a first input terminal of the flip-flop being electrically connected with a forward output terminal of the flip-flop and the gate of the switch tube, and a second input terminal of the flip-flop being electrically connected with the trigger signal input terminal;

an inverter, an input terminal of the inverter being electrically connected with the forward output terminal of the flip-flop, and an output terminal of the inverter being electrically connected with the first input terminal of the flip-flop and the gate of the switch tube; and a fourth resistor, one terminal of the fourth resistor being electrically connected with the first input terminal of the flip-flop, the output terminal of the inverter and the gate of the switch tube, and another terminal of the fourth resistor being grounded.

17. The display panel of claim 16, wherein the flip-flop is a D flip-flop.

18. The display panel of claim 15, wherein the trigger branch comprises:

a flip-flop, a first input terminal of the flip-flop being electrically connected with a reverse output terminal of the flip-flop and the gate of the switch tube, and a second input terminal of the flip-flop being electrically connected with the trigger signal input terminal; and a fourth resistor, one terminal of the fourth resistor being electrically connected with the first input terminal of the flip-flop, the reverse output terminal of the flip-flop and the gate of the switch tube, and another terminal of the fourth resistor being grounded.

* * * * *